United States Patent [19]

Schwind

[11] 4,448,248

[45] May 15, 1984

[54] ENHANCED FLOW TOOL POSITIONER

[75] Inventor: Edward C. Schwind, Burleson, Tex.

[73] Assignee: Gearhart Industries, Inc., Fort Worth, Tex.

[21] Appl. No.: 277,910

[22] Filed: Jun. 26, 1981

[51] Int. Cl.[3] ..... E21B 17/10

[52] U.S. Cl. ..... 166/241; 175/325; 308/4 A

[58] Field of Search ..... 166/241; 175/325; 308/4 A

[56] References Cited

U.S. PATENT DOCUMENTS

| | | | |
|---|---|---|---|
| 1,913,018 | 6/1933 | Berryman | 308/4 A |
| 2,715,552 | 8/1955 | Lane | 308/4 A |
| 3,080,926 | 3/1963 | Remp | 166/241 |
| 3,145,785 | 8/1964 | Kellner | 175/325 X |
| 3,197,262 | 7/1965 | Fairchild | 308/4 A |
| 3,320,004 | 5/1967 | Garrett | 308/4 A |
| 3,397,017 | 8/1968 | Grant et al. | 308/4 A |
| 3,894,780 | 7/1975 | Broussard | 308/4 A |
| 4,105,262 | 8/1978 | Richey | 308/4 A |

FOREIGN PATENT DOCUMENTS

| | | | |
|---|---|---|---|
| 674798 | 11/1963 | Canada | 175/325 |

*Primary Examiner*—William F. Pate, III
*Assistant Examiner*—Michael Starinsky
*Attorney, Agent, or Firm*—Hubbard, Thurman, Turner & Tucker

[57] ABSTRACT

A well tool positioner is adapted for positioning the tool in a desired relation within a well pipe. The positioner includes a generally cylindrical resilient body adapted to be closely mounted around a tool with the major outside diameter of the body being substantially no larger than the outside diameter of the tool. At least three support vanes are formed with the body as an integral member with each vane being generally ellipsoidal in cross-section and extending perpendicular from the axis of the body and with the major axis of the generally ellipsoidal shape extending along the axis of the body. The body defines an exterior annular recess in the vicinity of the support vanes such that the recess provides an increase in effective flow area between the body and the outer tips of the vanes which at least partially compensates for the decrease of such flow area as caused by the total thickness of the vanes.

4 Claims, 3 Drawing Figures

FIG. 1
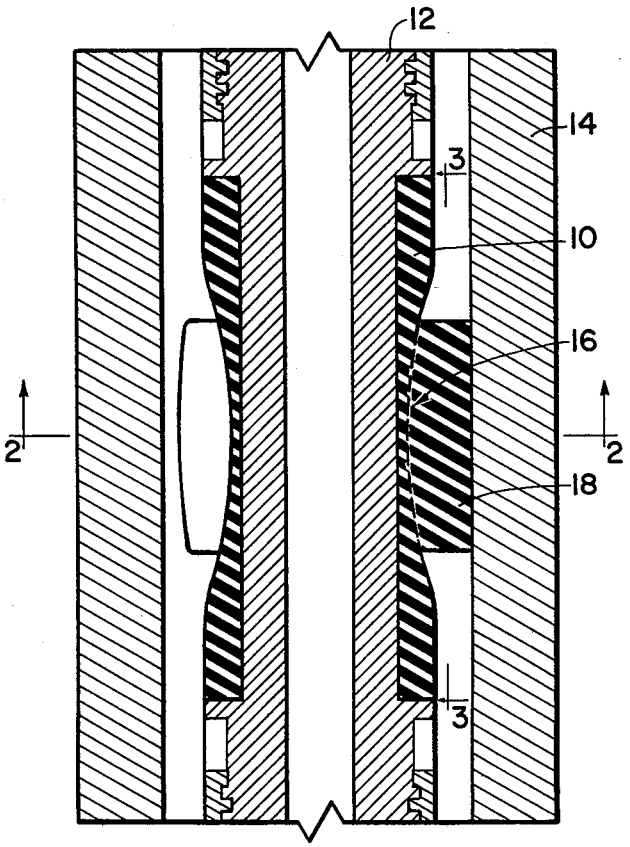
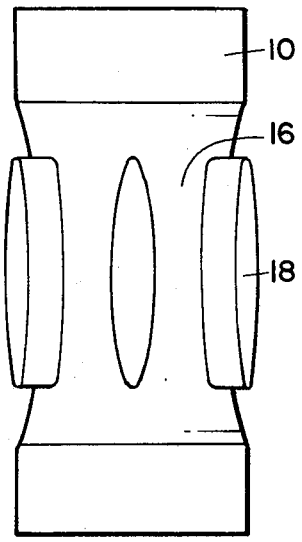
FIG. 3
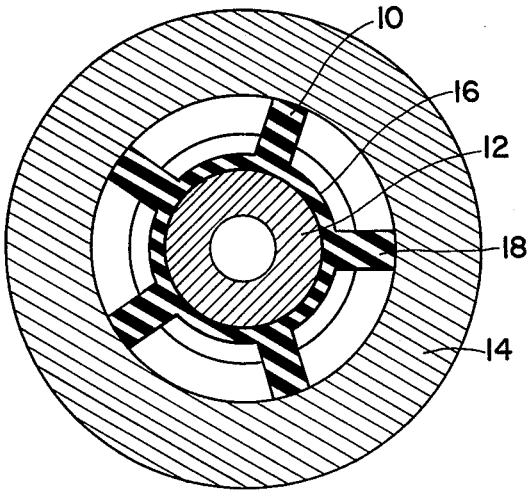
FIG. 2

ENHANCED FLOW TOOL POSITIONER

This invention generally pertains to tools used within well bores or within drilling pipe in well bores and more particularly pertains to apparatus for maintaining such tools in a centralized position within a circular hole or conduit.

BACKGROUND OF THE INVENTION

There have been a variety of centralizing mechanisms used to position tools within casing, drill pipe, tubing, and the like including drag springs, expandable and retractable linkages, cylindrical rubber posts extending laterally from the tool, metal fins, and the like.

In drill pipe or casing having internal upsets of reduced diameter, the centralizer must be able to flex or give slightly at the point of reduced diameter as the tool is being passed through the pipe, yet firmly and positively position the tool within the pipe when the tool is positioned for use. One example of such a tool as used within drill pipe is shown in U.S. Pat. No. 4,057,781, herein specifically incorporated by reference. Other such tools in use are disclosed in U.S. Pat. No. 3,494,186 and No. 3,410,136.

When such tools are installed in casing or drill pipe and used with fluid flowing through the pipe in high volume, the tool itself reduces the fluid flow cross-sectional area inside the pipe and the flow area is further reduced by the centralizing apparatus. It is usually necessary that the fluid flow area and fluid flow capacity through the pipe be maintained at or above certain specified minimum levels, both for the flow capacity and for providing reduced fluid drag on the tool itself.

OBJECTS OF THE INVENTION

One object of the present invention is to provide a centralizer apparatus which will provide enhanced flow area and corresponding flow rate in the annular space between a well tool and the interior of a well casing, drill pipe or the like.

Another object of the present invention is to provide a centralizing apparatus or well tool which may be flexed when the tool is passed through pipe having internal upsets or other sources of reduced internal diameter.

A further object of the invention is to provide a tool centralizer which will absorb shock loading between a well tool and a conduit or borehole in which it is situated.

A still further object of the invention is to provide a centralizing apparatus which is easily replaceable and which has improved wear characteristics suitable for use in an abrasive fluid environment.

SUMMARY OF THE INVENTION

The foregoing and other objects are attained by means of a centralizer apparatus adapted for mounting about a well tool, wherein said apparatus is positioned in centralized relation within a borehole or well pipe including a generally cylindrical resilient body adapted to be closely mounted around a tool with the major outside diameter of the resilient body being not substantially larger than the outside diameter of the tool. At least three support vanes are formed with the body as an integral member with each vane being generally ellipsoidal in cross-section and extending in a perpendicular direction from the axis of the resilient body and with the major axis of the ellipsoidal shape extending in a direction generally parallel with the cylindrical axis of the resilient body. The resilient body defines an exterior annular recess in the vicinity of the support vanes such that the recess provides an increase in effective flow area between the resilient body and the outer tips of the vanes, thus at least partially compensating for the decrease of such flow area caused by the presence of the vanes.

DESCRIPTION OF THE DRAWING

FIG. 1 is a longitudinal cross-sectional view of a well tool centralized by an embodiment of the present invention within a drill pipe.

FIG. 2 is a cross-section taken along the lines 2—2 of FIG. 1 which also shows the well tool positioned within the drill pipe.

FIG. 3 is a side elevation taken at lines 3—3 of FIG. 1 and showing an elevational view of the centralizing apparatus per se.

DESCRIPTION OF THE PREFERRED EMBODIMENT

Referring first to FIGS. 1 and 2, there is shown the centralizing article or apparatus 10 as mounted on a well tool 12. The tool 12 may be disposed within a section of drill pipe 14, as shown in U.S. Pat. No. 4,057,781, for example. As shown herein, the centralizer 10 is comprised of a resilient material having a designated resistance to flexure (e.g. Neoprene rubber or the like).

The centralizer 10 is preferably mounted, as shown, into a recessed annular space defined around the circumference of the tool 12 such that, when installed, the outer diameter of the body of centralizer 10 is substantially the same as the outer diameter of the remainder of the tool 12.

The centralizer 10 may be readily mounted into the position shown around tool 10 by stretching it over the tool 10 and sliding it into position with its inherent resilience providing the flexure needed for the change in internal diameter as it is moved over the tool and into the mounting space as shown. In mounting the centralizer 10 on the tool 12 as shown, a lubricant facilitates its installation. The lubricant can be water or a petroleum lubricant such as motor oil or grease or the like. However, the best lubricant known to the inventor, which for an added feature of reducing chemical deterioration of the rubber, is one made of a water soluble jell such as Johnson & Johnson's K-Y lubricant.

As can be seen with reference to FIGS. 1, 2, and 3, the middle portion of the centralizer 10 is defined as a generally concave profile defining an annular space 16 of reduced diameter around the centralizer 10 which space also provides increased annular flow area between the centralizer 10 and the drill pipe 14 when the tool 12 is disposed in the drill pipe as shown.

Disposed around the centralizer 10 at this space 16 of reduced diameter are a plurality of elongate centralizing fins 18 which are disposed to extend in a parallel direction along the cylindrical axis of tool 12.

As shown, there are five of such fins 18 provided. However, at least three such fins are required and more than five can be used, depending on the lateral loading on tool 12 and the specific design of the centralizer 10. As can be seen with reference to FIG. 3, each of such fins 18 is generally ellipsoidal in cross-section so as to form a flow vane which is stream-lined in nature with respect to the flow of fluids through the drill pipe 14.

As also can be seen with reference to FIGS. 1 and 3, the decrease in annular flow area as caused by the increase and decrease in thickness along each of the vanes 18 is at least partially offset and compensated for by an increase in flow area of space 16 as generated by the convex curvature of the outside diameter of the centralizer 10 through the section where the fins are situated.

Thus, fluid flowing through the drill pipe 14 and around the well tool 12 will pass between the fins 18, and, as the fins 18 increase in diameter to reduce the effective flow area, the convex area of reduced diameter of the tool 10 increases such effective flow area and thereby reduces any overall reduction of flow area for fluids passing by the centralizer 10.

In operation, the well tool 12, having one or more of the centralizers 10 mounted thereon, may be lowered through drill pipe or well casing as shown in the above referenced patents. At such time as the tool 12 is placed into position for use, fluids may be pumped through the recessed annular area with a corresponding reduction of flow impedance.

Though the centralizers 10 are resistent to abrasion from suspended solids in fluids, any ultimate damage to the centralizer apparatus is not of great consequence, since the tool may have the centralizers 10 easily replaced by either cutting off or slipping off a worn centralizer 10 and replacing same by slipping a new centralizer into place as previously described.

It is to be noted that the "centralizer" 10 as described herein and as shown in FIGS. 1–3 may be provided to support a tool, such as tool 12, at positions other than at the center of a conduit or pipe 14. For example, it may become desirable to position the tool 12 near one side of a pipe 14 in some installations to provide space for some other object to pass by the tool 12 within the pipe 14. In such event, each respective vane 18 would be provided to extend an appropriate distance from the axis of tool 12 such that tool 12 would be positioned and supported away from the center or axis of pipe 14. For this reason the commonly used term "centralizer" as used in this description is herein intended to more broadly include "positioner".

It will be apparent to those skilled in the art that various modifications or variations can be made to the preferred embodiment of the invention as shown herein without departing from the scope of the appended claims.

I claim:

1. Apparatus for centering a tubular member comprising:

a generally cylindrical resilient body adapted to be mounted around said tubular member; and at least three resilient vanes mounted longitudinally about said resilient body, each of said at least three resilient vanes having a varying cross-sectional width, said generally resilient body varying in diameter in inverse proportion to the cross-sectional width of each of said at least three resilient vanes wherein the cross-sectional area between any two adjacent resilient vanes is substantially constant along the axis of said tubular member.

2. The apparatus according to claim 1 wherein said resilient vanes extend perpendicularly from the axis of said generally cylindrical resilient body.

3. The apparatus according to claim 1 wherein said generally cylindrical resilient body is constructed of a Neoprene compound.

4. The apparatus according to claim 1 wherein a total of five resilient support vanes are provided.

* * * * *